US008561674B2

(12) United States Patent
Lin et al.

(10) Patent No.: US 8,561,674 B2
(45) Date of Patent: Oct. 22, 2013

(54) HEAT DISSIPATION MODULE AND HEAT PIPE THEREOF

(75) Inventors: Chi-Feng Lin, Taoyuan Hsien (TW); Min-Hui Yu, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 743 days.

(21) Appl. No.: 12/204,954

(22) Filed: Sep. 5, 2008

(65) Prior Publication Data

US 2009/0236080 A1 Sep. 24, 2009

(30) Foreign Application Priority Data

Mar. 21, 2008 (TW) ..... 97110112 A

(51) Int. Cl.
*F28D 15/00* (2006.01)
*H05K 7/20* (2006.01)

(52) U.S. Cl.
USPC ..... 165/104.26; 165/104.21; 165/104.33; 361/700

(58) Field of Classification Search
USPC ..... 165/104.21, 104.26, 104.33; 361/700
See application file for complete search history.

(56) References Cited

U.S. PATENT DOCUMENTS

| | | | | |
|---|---|---|---|---|
| 1,924,294 | A * | 8/1933 | Shirk et al. | 72/257 |
| 5,046,553 | A * | 9/1991 | Lindner | 165/104.26 |
| 7,051,794 | B2 * | 5/2006 | Luo | 165/104.26 |
| 2005/0082039 | A1 * | 4/2005 | Connors et al. | 165/104.26 |
| 2006/0201656 | A1 * | 9/2006 | Lai et al. | 165/104.26 |
| 2006/0283574 | A1 * | 12/2006 | Huang | 165/104.26 |
| 2007/0102143 | A1 * | 5/2007 | Yu et al. | 165/80.3 |

FOREIGN PATENT DOCUMENTS

| | | |
|---|---|---|
| TW | 487301 | 5/2002 |
| TW | M257478 | 2/2005 |
| TW | M286407 | 1/2006 |

* cited by examiner

*Primary Examiner* — Allen Flanigan
*Assistant Examiner* — Jason Thompson
(74) *Attorney, Agent, or Firm* — Muncy, Geissler, Olds & Lowe, PLLC

(57) ABSTRACT

A heat dissipation module includes a plurality of fins and a heat pipe connected with the fins. The heat pipe includes a body, which forms an enclosed space, and an inner ring. A wick structure is disposed on the inner surface of the body, and the inner ring is disposed in the enclosed space for increasing a structural strength of the heat pipe. The inner ring is pressed against the top and bottom of the body or in contact with the wick structure located at the top and the bottom of the body, respectively. The inner ring includes at least one opening located close to the top of the body for communicating inside and outside of the inner ring.

13 Claims, 7 Drawing Sheets

B-B

HEAT DISSIPATION MODULE AND HEAT PIPE THEREOF

CROSS REFERENCE TO RELATED APPLICATIONS

This Non-provisional application claims priority under 35 U.S.C. §119(a) on Patent Application No(s). 097110112, filed in Taiwan, Republic of China on Mar. 21, 2008, the entire contents of which are hereby incorporated by reference.

BACKGROUND OF THE INVENTION

1. Field of Invention

The present invention relates to a heat dissipation module and a heat pipe thereof. More particular, the present invention relates to a heat pipe with strong structural strength that is applied to a heat dissipation module.

2. Related Art

According to the development of technology, the density of the transistors on an electronic product increases, and thus the electronic product may generate more heat. Because a heat pipe is a simple and efficiency heat dissipation device, it has been wildly applied to various kinds of electronic products.

As shown in FIG. 1, a conventional vertical heat pipe is used to CPU for dissipating heats. However, in order to satisfy the demands of high thermo-conducting efficiency for the present electronic products, the base 11 with larger surface area for heat conducting is required. Also, it is also desired to make the product lighter and more compact. However, since the surface area for heat conducting is enlarged and the thickness of the base 11 is kept the same, the structural strength of the connection between the base 11 and the heat source F becomes weaker. Therefore, the deformation "D" may be caused on the base 11 when the base 11 is used onto a heat source. If the thickness of the base 11 is increased to solve the above-mentioned problem, the thermoconducting efficiency thereof is decreased.

SUMMARY OF THE INVENTION

In view of the foregoing, the present invention is to provide a heat pipe having an inner ring for supporting so as to provide sufficient structural strength and prevent the heat pipe from deformation.

To achieve the above, the present invention discloses a heat dissipation module including a plurality of fins and a heat pipe. The heat pipe includes a body, a wick structure and an inner ring. The body forms an enclosed space. The wick structure is disposed on an inner surface of the body. The inner ring is disposed in the enclosed space for increasing a structural strength of the heat pipe and the inner ring is pressed against the top and the bottom of the body or in contact with the wick structure located at the top and the bottom of the body, respectively. The inner ring includes at least one opening located close to the top of the body for communicating inside and outside of the inner ring.

The above-mentioned inner ring, which is pressed against the top and bottom of the body, can be configured to support the body, so that the deformation of the surface of the body contact with the heat source, which is caused by the locking force for contacting the body with the heat source, can be prevented. Accordingly, the thickness of the bottom can be thinner and the thermo-conducting efficiency can be enhanced.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

First Embodiment

Figure 1:
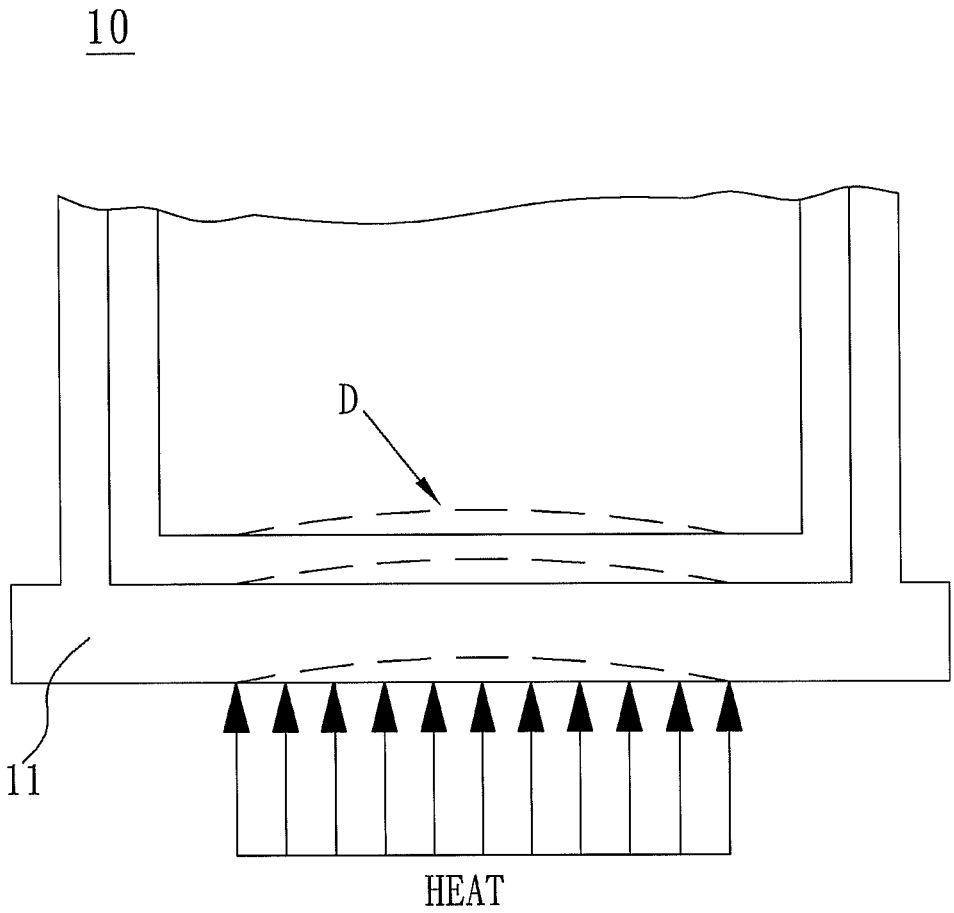
FIG. 1(PRIOR ART)
FIG. 1 is a sectional view of the conventional heat pipe.
Figure 2:
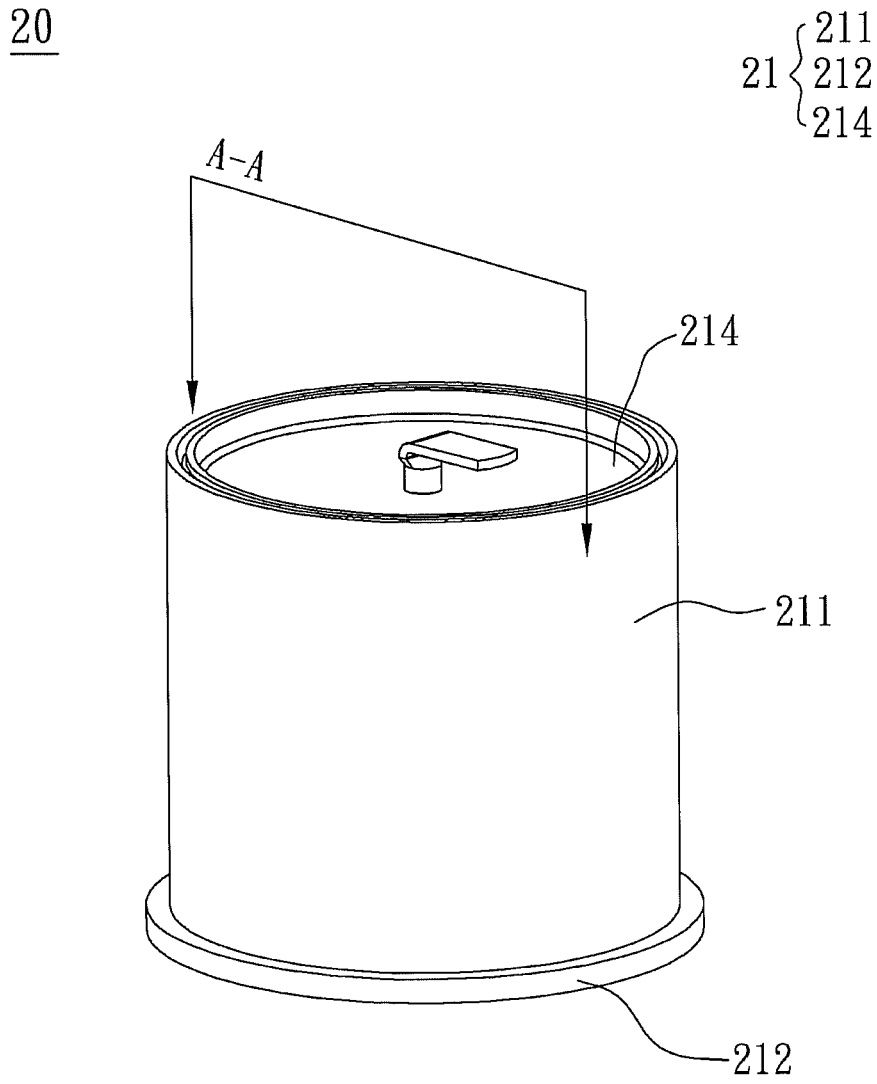
FIG. 2 is a three-dimensional diagram showing a heat pipe according to a first embodiment of the present invention.
Figure 3:
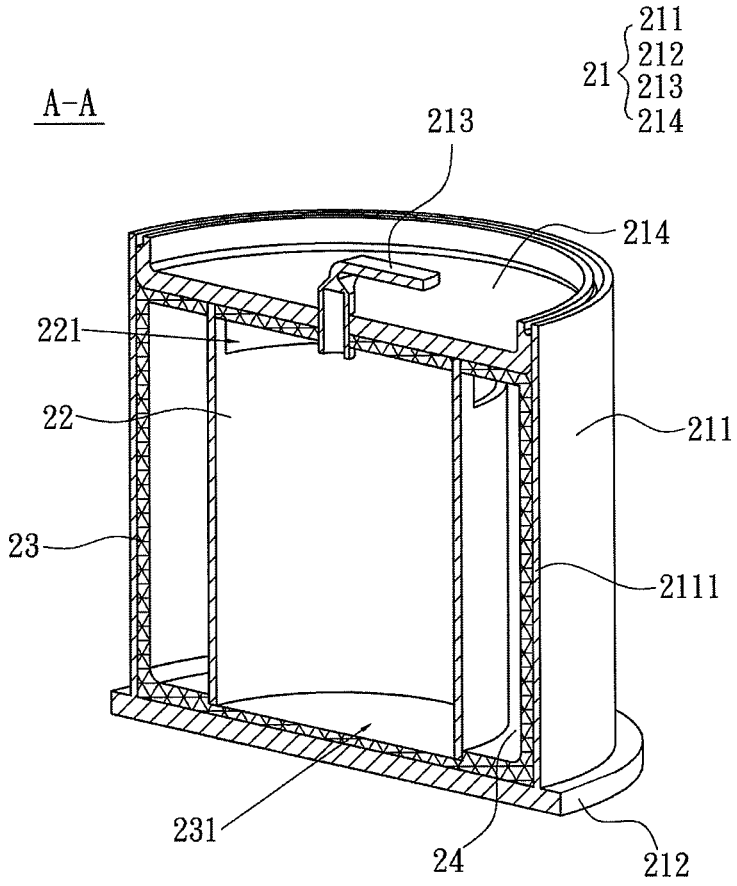
FIG. 3 is a sectional view along the line A-A of FIG. 2.

With reference to FIGS. 2 and 3, a heat pipe 20 according to a first embodiment of the present invention includes a body 21, an inner ring 22, and a wick structure 23. The body 21 forms an enclosed space, and the wick structure 23 is a continuous or separated structure disposed on an inner surface of the body 21. The body 21 includes an outer ring 211, a base 212 and a cover 214. The inner ring 22 is disposed in the enclosed space, and the inner ring 22 is pressed against the top and bottom of the body 21 or in contact with the top and bottom of the wick structure 23, respectively. The inner ring 22 has an opening 221 located close to the cover 214 for communicating inside and outside of the inner ring 22. The wick structure 23 has an annular recess 231 located on the base 212. The annular recess 231 is used for assembling and positioning the inner ring 22, so that the inner ring 22 will not be moved and lose the supporting effect.

The wick structure 23 is disposed on the inner surface of the body 21 and the wick structure 23 has a porous structure that is spring-shaped, groove-shaped, column-shaped, net-shaped or made by metal powder. The wick structure 23 can be formed by sintering, adhering, packing, depositing or their combinations. The wick structure 23 located at a sidewall such as outer ring 211 of the body 21 maintains a predetermined distance from the inner ring to define a commodious passage 24 for being passed through by an evaporated working fluid such that the wick structure 23 located at the sidewall of the body 21 does not fit snug around the inner ring 22. In addition, the enclosed space may further contain working fluids, which can be inorganic compound, pure water, alcohol, ketone, liquid metal, refrigerant, organic compound or their combination. The working fluids (not shown) can be injected through an injecting tube 213 passing through the cover 214 of the body 21 before the injecting tube 213 is sealed to make the inside of the body 21 become enclosed and vacuum.

When the base 212 is in contact with a heat source, such as a CPU, the working fluids can absorb the heats generated from the heat source and then be evaporated. Since the heat source is concentrated at the center of the base 212, the evaporated working fluids will move upward and flow into the space between the inner ring 22 and the outer ring 211 by passing through the opening 221 of the inner ring 22. Thus, the gas-phase working fluids can be in contact with the outer ring 211 and then condensed into the liquid-phase working fluids. Then, the liquid-phase working fluids can flow back to the base 212 through the wick structure 23. This cycle can achieve the effect of cooling the heat source.

In addition, the outer ring 211 and the inner ring 22 can be respectively formed as a single piece by an extruding process, a stretching process or a punching process followed by a bending process. The material of the outer ring 212 and the inner ring 22 can be a high thermo-conductive material such as aluminum, copper, titanium, molybdenum, silver, stainless steel, carbon steel or other alloy. The cross section of the outer ring 212 and the inner ring 22 can be elliptical, half-circular, rectangular, equilateral polygonal or scalene polygonal.

Figure 4:
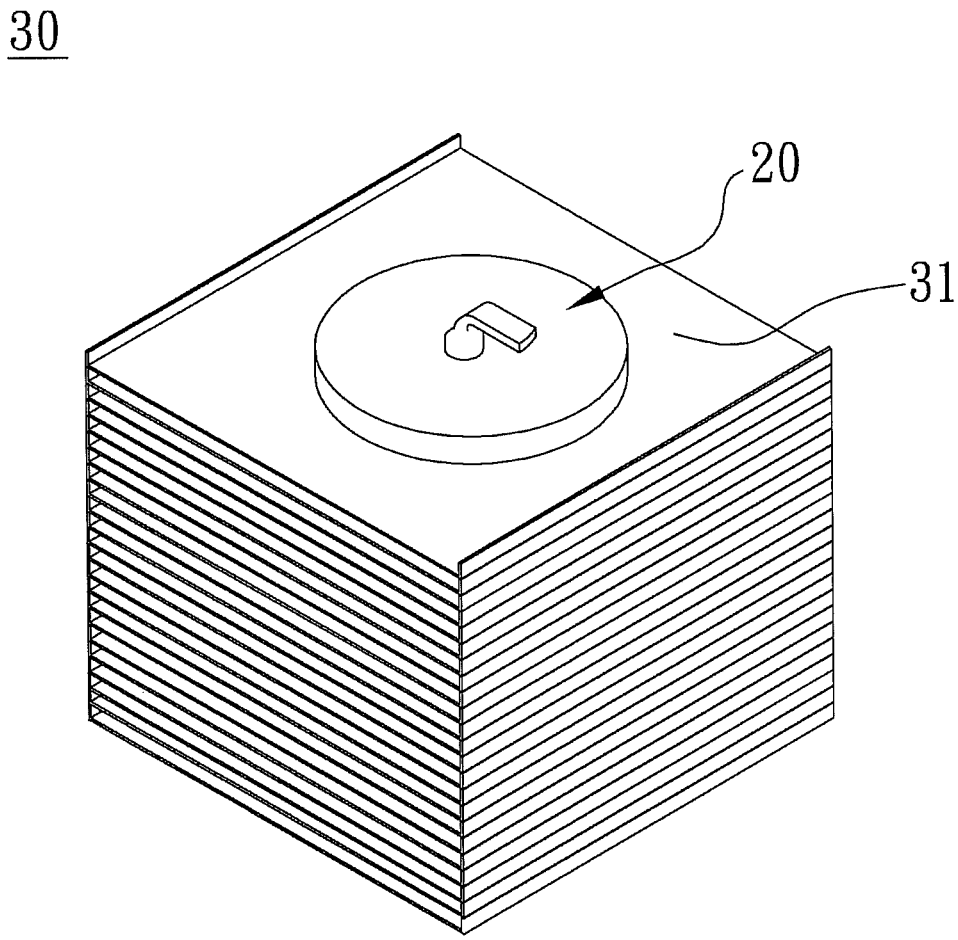
FIG. 4 is a schematic illustration showing a heat dissipation module utilizing the heat pipe of the first embodiment.

FIG. 4 is a schematic illustration showing a heat dissipation module 30 utilizing the heat pipe 20 of the first embodiment. In the heat dissipation module 30, the heat pipe 20 is connected with a plurality of fins 31 for enhancing the heat dissipation effect.

Second Embodiment

Figure 5:
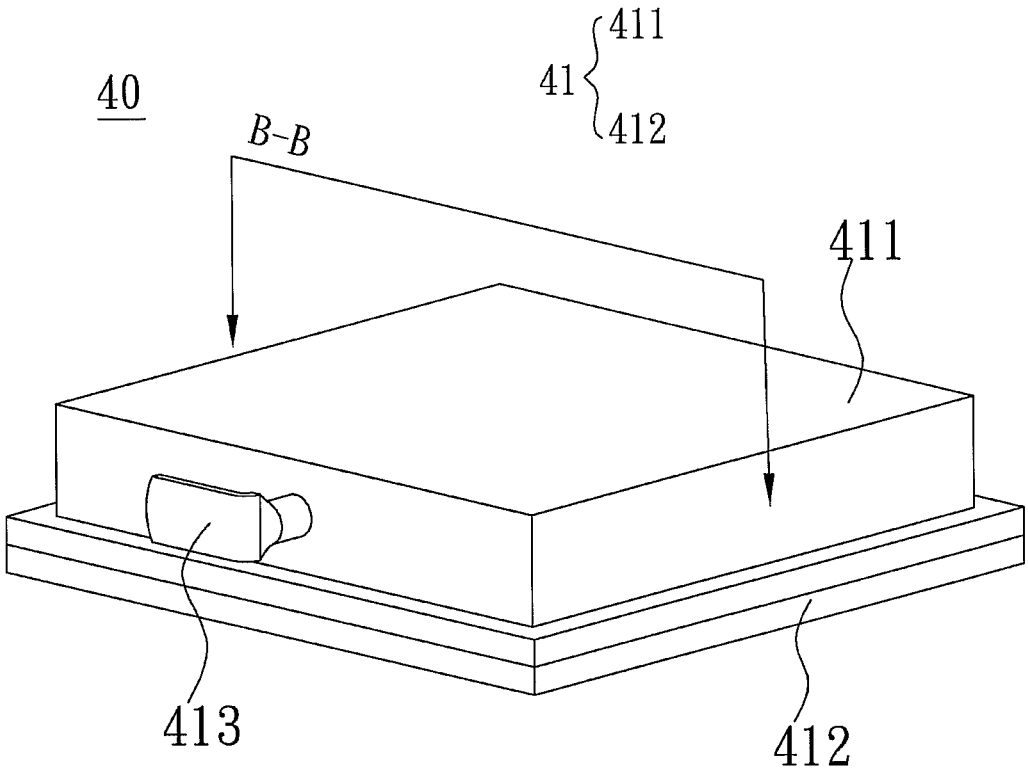
FIG. 5 is a three-dimensional diagram showing a heat pipe according to a second embodiment of the present invention.
Figure 6:
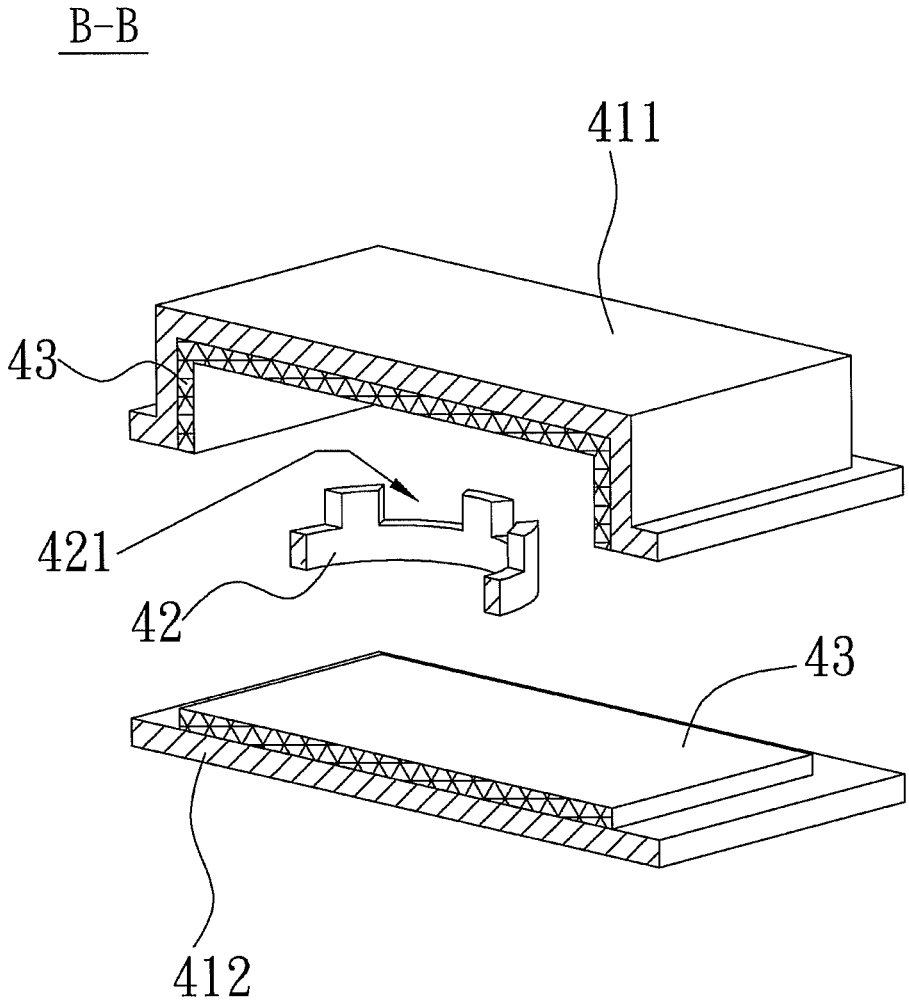
FIG. 6 is an exploded sectional view along the line B-B of FIG. 5.
Figure 7:
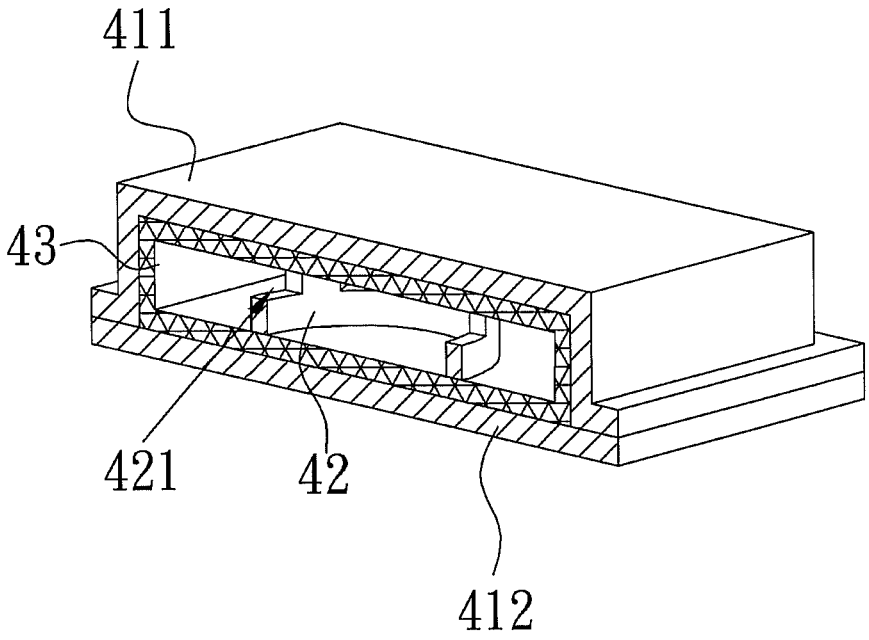
FIG. 7 is a three-dimensional sectional view along the line B-B of FIG. 5.

Referring all to FIGS. 5, 6 and 7, the difference between the first and second embodiments is in that the body 41 of the second embodiment is a flat plate structure and it is composed of an upper body 411 and a lower body 412. A wick structure 43 is disposed on an inner surface of the body 41. An inner ring 42, which has an opening 421 for communicating inside and outside of the inner ring 42, is disposed in the closed space and is in contact with parts of the wick structure 43 located at the inner surfaces of the upper body 411 and the lower body 412 when the upper body 411 and the lower body 412 are combined and connected. When the lower body 412 is in contact with a heat source, such as a CPU, the working fluids can absorb the heats generated by the heat source and then be evaporated. Since the heat source is concentrated at the center of the lower body 412, the evaporated working fluids will flow from inside of the inner ring 42 into the space of the upper body 411 by passing through the opening 421 of the inner ring 42. Thus, the gas-phase working fluids can be in contact with the upper body 412 and then condensed into the liquid-phase working fluids. Then, the liquid-phase working fluids can flow back to the lower body 412 through the wick structure 43. This cycle can achieve the effect of cooling the heat source.

In summary, the heat pipe 20/40 of the present invention provides the inner ring 22/42, which is pressed against the base 212 or the lower body 412. The inner ring 22/42 can be configured to support the body 21/41, so that the deformation of the base 212 or the lower body 412, which is caused by the external locking force for contacting the base 212 or the lower body 412 with the heat source, can be prevented. Furthermore, the worse heat dissipation effect due to the deformation of the base 212 or the lower body 412 can be prevented.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A heat pipe, comprising:

a body forming an enclosed space and comprising an sidewall, a base and a cover;

a wick structure disposed on an inner surface of the body, and the wick structure has an annular recess located on the base; and an inner ring disposed in the enclosed space for increasing a structure strength of the heat pipe, wherein a bottom of the inner ring is disposed on the annular recess of the wick structure, and a top of the inner ring contacts with the cover of the body and is encompassed by the wick structure located at the cover, the inner ring comprises at least one opening located close to the cover of the body for communicating inside and outside of the inner ring, the wick structure located at the sidewall of the body maintains a predetermined distance from the inner ring to define a commodious passage for being passed through by an evaporated working fluid such that the wick structure located at the sidewall of the body does not fit snug around the inner ring, the wick structure is flowed through by a liquid-phase working fluid, and the base is in contact with a heat source, such that the liquid-phase working fluid flows back to the base through the wick structure on the inner surface of the body.

2. The heat pipe according to claim 1, wherein the wick structure has a porous structure that is spring-shaped, groove-shaped, column-shaped, net-shaped or made by metal powder.

3. The heat pipe according to claim 1, wherein the evaporated and liquid-phase working fluids are accommodated in the enclosed space, and the evaporated and liquid-phase working fluids comprise inorganic compound, pure water, alcohol, ketone, liquid metal, refrigerant, organic compound or their combinations.

4. The heat pipe according to claim 3, wherein the body further includes an injecting tube, and the liquid-phase working fluids are injected into the heat pipe through the injecting tube.

5. The heat pipe according to claim 1, wherein the body is a flat plate structure, the sidewall and the cover are integrated as an upper body, the base is a lower body, and the upper body and the lower body are connected with each other to form the enclosed space.

6. The heat pipe according to claim 1, wherein the annular recess is used for assembling and positioning the inner ring, and a shape of the annular recess corresponds to a shape of the bottom of the inner ring.

7. The heat pipe according to claim 5, wherein a material of the upper body, the lower body and the inner ring comprise a high thermo-conductive material, and the high thermo-conductive material comprises aluminum, copper, titanium, molybdenum, silver, stainless steel, carbon steel or other alloy.

8. The heat pipe according to claim 1, wherein the body is a column structure, the sidewall is an outer ring, and the outer ring, the base and the cover are connected together to form the enclosed space.

9. The heat pipe according to claim 8, wherein the outer ring and the base are integrally formed as a single piece or two separated components.

10. The heat pipe according to claim 8, wherein a material of the outer ring and the inner ring comprise a high thermo-conductive material, and the high thermo-conductive material comprises aluminum, copper, titanium, molybdenum, silver, stainless steel, carbon steel or other alloy.

11. The heat pipe according to claim 1, wherein a cross section of the inner ring is elliptical, half-circular, rectangular, equilateral polygonal or scalene polygonal.

12. The heat pipe according to claim 1, wherein the heat pipe is connected to a plurality of fins so as to constitute a heat dissipation module.

13. A heat dissipation module, comprising:

a plurality of fins; and a heat pipe connected to the fins and comprising a body and an inner ring, wherein the body forms an enclosed space and comprises a sidewall, a base and a cover, a wick structure is disposed on an inner surface of the body, and the wick structure has an annular recess located on the base, the inner ring is disposed in the enclosed space for increasing a structure strength of the heat pipe, a bottom of the inner ring is disposed on the annular recess of the wick structure, and a top of the inner ring contacts with the cover of the body and is encompassed by the wick structure located at the cover, the inner ring comprises at least one opening located close to the cover of the body for communicating inside and outside of the inner ring, the wick structure located at the sidewall of the body maintains a predetermined distance from the inner ring to define a commodious passage for being passed through by an evaporated working fluid such that the wick structure located at the sidewall of the body does not fit snug around the inner ring, the wick structure is flowed through by a liquid-phase working fluid, and the base is in contact with a heat source, such that the liquid-phase working fluid flows back to the base through the wick structure on the inner surface of the body.

* * * * *